US009330838B2

(12) United States Patent
Fukuzawa et al.

(10) Patent No.: US 9,330,838 B2
(45) Date of Patent: May 3, 2016

(54) COIL UNIT

(71) Applicant: TDK CORPORATION, Tokyo (JP)

(72) Inventors: Narutoshi Fukuzawa, Tokyo (JP); Toshinori Matsuura, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 14/554,990

(22) Filed: Nov. 26, 2014

(65) Prior Publication Data

US 2015/0145632 A1 May 28, 2015

(30) Foreign Application Priority Data

Nov. 28, 2013 (JP) ..... 2013-246454
Oct. 15, 2014 (JP) ..... 2014-210938

(51) Int. Cl.

| | |
|---|---|
| ***H01F 17/04*** | (2006.01) |
| ***H01F 5/00*** | (2006.01) |
| ***H01F 27/28*** | (2006.01) |
| ***H01F 38/14*** | (2006.01) |
| *H01F 3/10* | (2006.01) |

(52) U.S. Cl.
CPC . *H01F 38/14* (2013.01); *H01F 3/10* (2013.01)

(58) Field of Classification Search
CPC ..... H01F 3/10
USPC ..... 336/200, 223, 232, 221
See application file for complete search history.

(56) References Cited

U.S. PATENT DOCUMENTS

| | | | |
|---|---|---|---|
| 2012/0062435 | A1 | 3/2012 | Kato et al. |
| 2012/0218068 | A1 | 8/2012 | Yamakawa et al. |

FOREIGN PATENT DOCUMENTS

| | | |
|---|---|---|
| JP | B2-4277596 | 6/2009 |
| JP | A-2011-211337 | 10/2011 |
| JP | A-2012-178959 | 9/2012 |
| WO | 2006/036012 A1 | 4/2006 |

OTHER PUBLICATIONS

May 4, 2015 Extended European Search Report issued in European Application No. 14195215.0.

*Primary Examiner* — Mangtin Lian
*Assistant Examiner* — Ronald Hinson
(74) *Attorney, Agent, or Firm* — Oliff PLC

(57) ABSTRACT

A coil unit in which impact resistance is ensured and that has a magnetic body for heating prevention. The coil unit (the power receiving coil unit) includes a winding wire (the winding wire portion) and a magnetic body, wherein in the magnetic body, a plurality of individual pieces with two principle surfaces opposing in a thickness direction are disposed in rows and columns in a direction substantially orthogonal to the thickness direction, and the two principle surfaces are in a polygonal shape and all interior angles forming a polygon are obtuse angles (except for a right angle).

3 Claims, 10 Drawing Sheets

COIL UNIT

The present invention relates to a coil unit.

BACKGROUND

For the purpose of improving the transfer efficiency, the coil unit used in a wireless power supply system is composed of a magnetic body in order to increase the coupling coefficient between the coil unit for power transmission and the coil unit for power reception. When the magnetic body is composed by ceramic material, its mechanical stress is quite weak due to its hardness and fragility, and cracks would be produced once a certain impact is applied, and thus special attentions should be paid.

For such a requirement, Patent Document 1 has disclosed that the ferrite layer which is divided into ferrite sheets, the longest side of which is ten times or less as long as that of thickness, has been sufficiently divided so that it can be prevented from being further divided even a stress is applied when it is being mounted or after it is mounted.

PATENT DOCUMENT

Patent Document 1: JP-A-2011-211337

SUMMARY

However, when the coil unit of the wireless power supply system in an electric vehicle or the like which needs high power transmission utilizes the technique disclosed in Patent Document 1, even if the ferrite layer is prepared into an individual piece to ensure the impact resistance, a new technical problem arises that the adjacent location between individual pieces may be locally heated.

In specific, the magnetic flux passing through the magnetic body has a property of congregating to a direct with a low magnetic resistance while there is a linear relationship between the magnetic flux density and the hysteresis loss or eddy current loss of the magnetic body, and thus the congregation of the magnetic flux i.e., the increase of the magnetic flux density has a tendency of involving local heating. However, in the ferrite layer as disclosed in Patent Document 1 which is divided into a plurality of ferrite sheets with irregular shapes, since the situation that the sharp corner portions between the adjacent individual pieces get close occurs, the magnetic flux is concentrated to the part with a low magnetic resistance i.e., the sharp corner portion of the individual piece, and thus a concern is present that the local intense heating may occur.

Therefore, the present invention is completed in view of the situation mentioned above, the aim of which is to provide a coil unit in which impact resistance is ensured and that has a magnetic body for heating prevention.

The coil unit according to the present invention that is a coil unit for wirelessly transmitting or receiving the power comprises a winding wire and a magnetic body, wherein in the magnetic body, a plurality of individual pieces with two principle surfaces opposing in a thickness direction are disposed in rows and columns in a direction substantially orthogonal to the thickness direction, and the two principle surfaces are in a polygonal shape, and interior angles forming a polygon are all obtuse angles (except for a right angle).

According to the present invention, since the magnetic body is composed of a plurality of individual pieces, a cracking of the magnetic body can be prevented even if a stress is applied, and thus an impact resistance can be ensured. In addition, since there are no sharp angles for interior angles in the two principle surfaces opposing in the thickness direction, a concentration of a magnetic flux can be inhibited at an adjacent location between individual pieces and a local heating at the adjacent location can be prevented.

The coil unit of the present invention that is a coil unit for wirelessly transmitting or receiving the power comprises a winding wire and a magnetic body, wherein in the magnetic body, a plurality of individual pieces with two principle surfaces opposing in a thickness direction are disposed in rows and columns in a direction substantially orthogonal to the thickness direction, and the two principle surfaces are in a substantially circular shape.

According to the present invention, since the magnetic body is composed of a plurality of individual pieces, a cracking of the magnetic body can be prevented even if a stress is applied and thus an impact resistance can be ensured. In addition, since there are no sharp angles for interior angles in the two principle surfaces opposing in the thickness direction, a concentration of a magnetic flux can be inhibited at an adjacent location between individual pieces and a local heating can be prevented at the adjacent location. In addition, since each individual piece is in a substantially circular shape, a powder of the magnetic body generated due to a friction caused by an impact at the adjacent location between individual pieces can be effectively prevented from dropping off.

Preferably, a plurality of individual pieces can be disposed in a zigzag pattern. In this case, since a number of the individual pieces per volume can be increased in the coil unit, an actual specific permeability of the coil unit can be increased, and further, a coupling efficiency between a power transmitting coil unit and a power receiving coil unit is improved.

Preferably, a plurality of individual pieces can be disposed in layers in the thickness direction, and the central parts of a plurality of individual pieces do not overlap each other when viewed from the thickness direction. In this case, an adjacent location between individual pieces disposed in rows and columns at one of the adjacent layers does not coincide with the adjacent location between individual pieces disposed in rows and columns at the other one of the adjacent layers in the thickness direction, and thus part of a magnetic flux leaked to outside the magnetic body will enter the individual piece in an adjacent layer during the magnetic flux passing through the adjacent location between individual pieces so that the magnetic flux will hardly leak to outside a power receiving coil unit. As a result, an actual magnetic permeability of the power receiving coil unit is increased, and further, a coupling efficiency between a power transmitting coil unit and the power receiving coil unit can be improved.

According to the present invention, a coil unit can be provided in which impact resistance is ensured and that has a magnetic body for heating prevention.

DESCRIPTION OF REFERENCE NUMERALS

Figure 1:
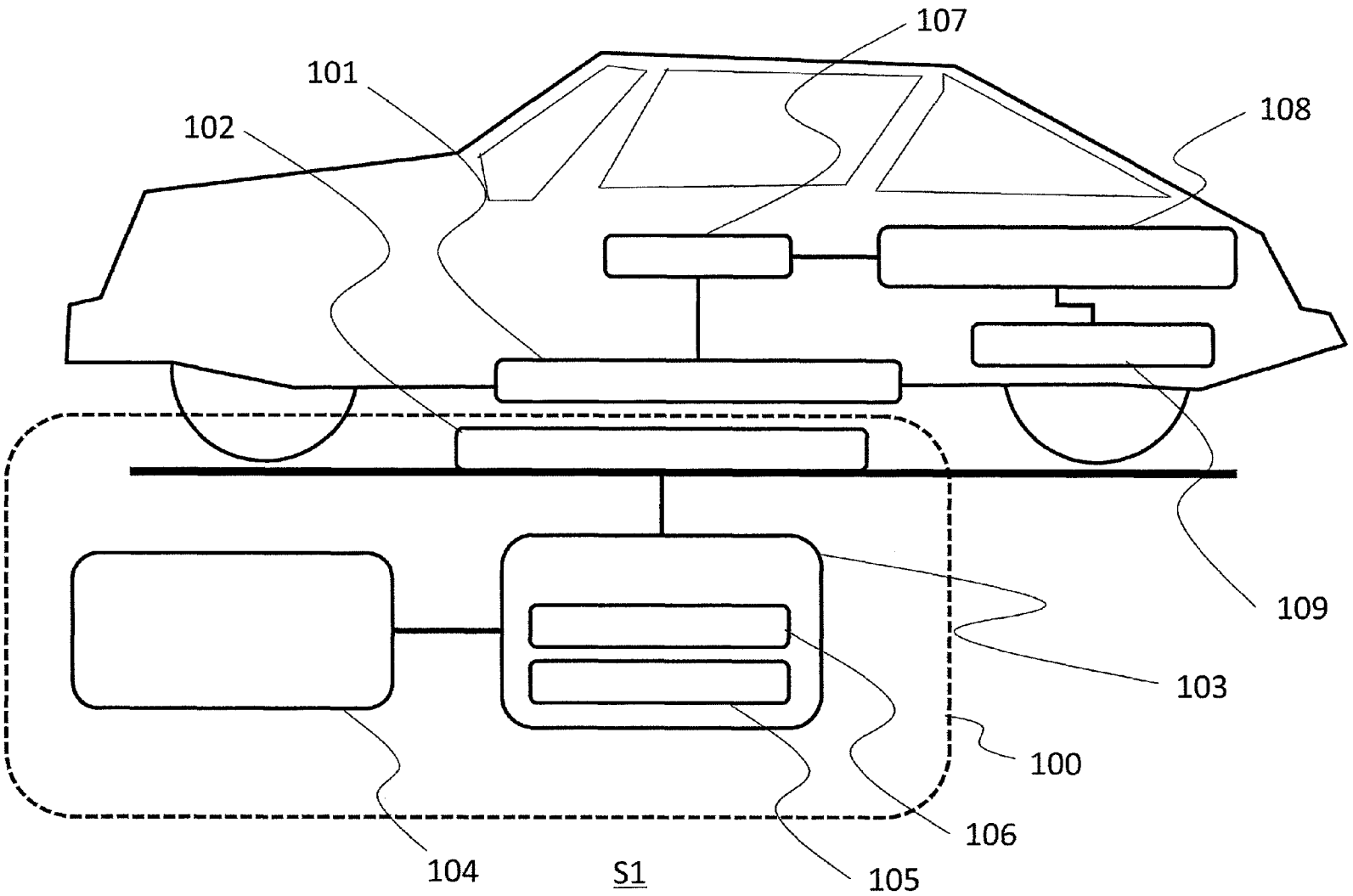
FIG. 1 is a block diagram showing a wireless power supply system which uses the coil unit according to embodiments of the present invention.

100 the power supply station
101 the power receiving coil unit
102 the power transmitting coil unit
200 the winding wire portion
201 the capacitor unit portion
203 the shield portion
202, 300, 400, 500, 600, 700, 800, 900 the magnetic body
701, 801, 901 a plurality of individual pieces forming the magnetic body

DETAILED DESCRIPTION OF EMBODIMENTS

Hereinafter, the embodiments of the present invention will be described with reference to the drawings. In addition, the same reference numeral refers to the same element or an element having the same function, and repeated descriptions will be omitted in the description.

FIG. 1 is a block diagram showing a wireless power supply system S1 which uses the coil unit according to the preferable embodiment of the present invention. The wireless power supply system S1 which uses the coil unit according to the preferable embodiment of the present invention can be, for example, a system for charging a vehicle such as a battery electric vehicle (BEV) or a plug-in hybrid electric vehicle (PHEV).

The wireless power supply system Si is provided at a power supply station 100 where vehicles can be parked in order to wirelessly transmit the power to the vehicles. The driver of a vehicle can manually or automatically park the vehicle at the power supply station 100 provided with the wireless power supply system S1, so that the power receiving coil unit 101 mounted in the vehicle is faced to the power transmitting coil unit 102.

From the view of shortening the charging time, i.e., the convenience, the power wirelessly transmitted is necessary at least 1.5 kW or more, and a power transmission of 3.3 kW or more is required.

At the power supply station 100, the power transmitting coil unit 102 or the like is provided on the ground surface below the vehicle or is embedded in the ground, and a power supply portion 103 and a commercial power line 104 are connected to the power transmitting coil unit 102.

The power supply portion 103 in the wireless power supply system S1 is composed of a converter portion 105 for converting an alternating current power with a commercial frequency from the input commercial power line 104 into a direct current power and a inverter portion 106 for transforming the direct voltage in the direct current power into an alternating square-wave voltage near the resonant frequency which will be described later. The inverter portion 106 is composed of, for example, four MOSFETs (Metal Oxide Semiconductor Field Effect Transistor) connected in full bridge.

The power transmitting coil unit 102 is mainly composed of a LC resonant circuit and is capable of transmitting the power output from the power transmitting coil unit 102 to the power receiving coil unit 101 by resonating with the oppositely disposed power receiving coil unit 101 which is mainly composed of the LC resonant circuit provided in the vehicle. In order to cause resonance between the power transmitting coil unit 102 and the power receiving coil unit 101, it is required that the resonant frequencies of the power receiving coil unit 102 and the power transmitting coil unit 101 get extremely close to each other. Thus, the inverter portion 106 can provide an alternating square-wave voltage near the resonant frequencies of the power transmitting coil unit 102 and the power receiving coil unit 101 to the power transmitting coil unit 102.

Next, the structure disposed at the vehicle side will be explained. The power receiving coil unit 101 is disposed on the bottom part of the vehicle.

As a result of the resonance with the power transmitting coil unit 102, the alternating current power received in the power receiving coil unit 101 is rectified in a rectification portion 107, and the rectified power is stored in a battery 109 via a DC/DC converter 108.

Then, the structure of the coil unit according to the preferable embodiments in the present invention will be described in detail. Further, the coil unit according to the preferable embodiments of the present invention is applicable to either of a power receiving coil unit and a power transmitting coil unit. In the following embodiment, an example applied to a power receiving coil unit in which impact resistance is particularly required will be described.

(The First Embodiment)

Figure 2:
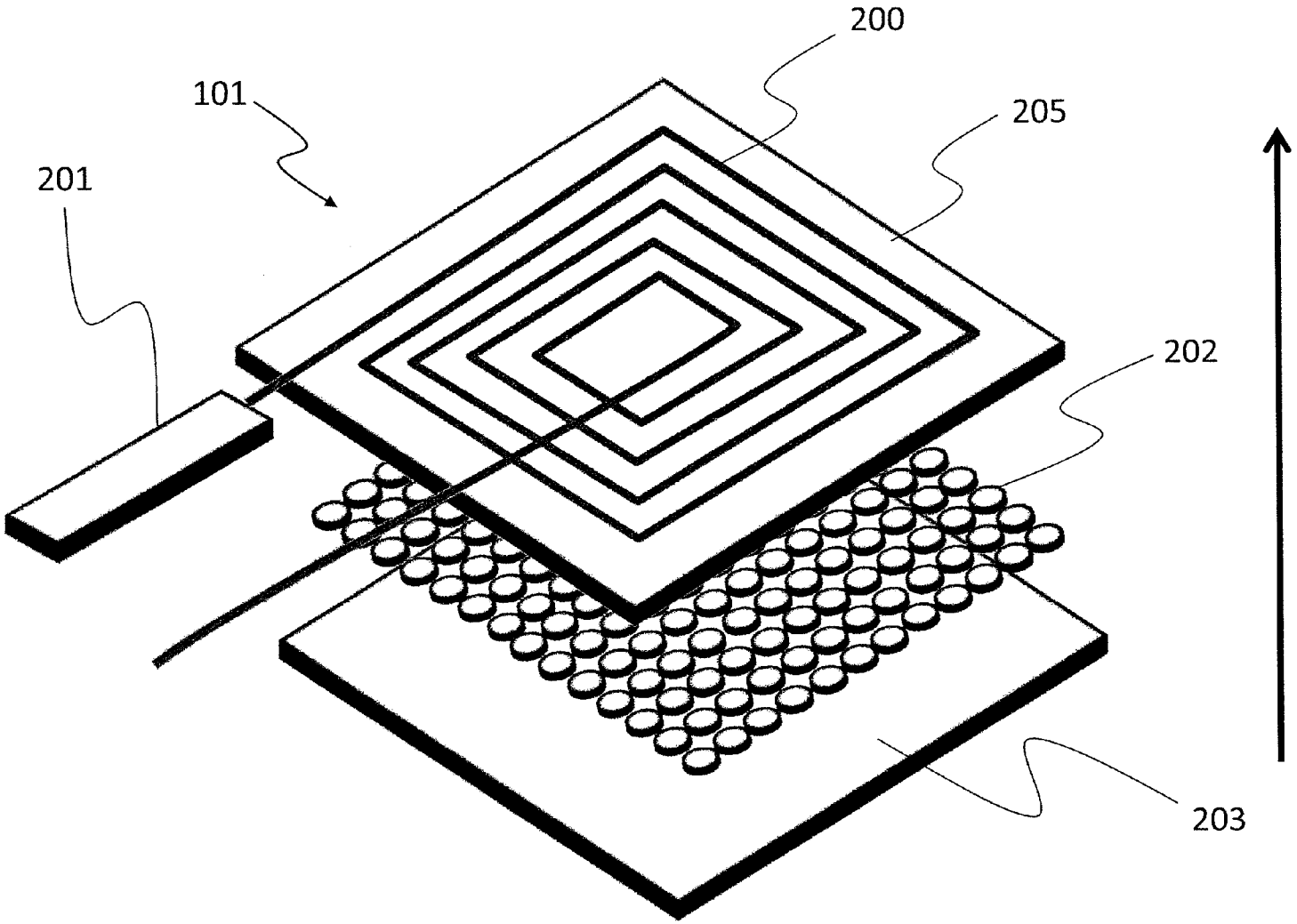
FIG. 2 is a schematic perspective view showing the power receiving coil unit according to the first embodiment of the present invention.

FIG. 2 is a schematic perspective view showing the power receiving coil unit according to the first embodiment of the present invention. Herein, the thickness direction of a magnetic body 202 (hereinafter only referred to as "the thickness direction") refers to the arrow direction illustrated in FIG. 2.

The power receiving coil unit 101 comprises a winding wire portion 200 formed by winding a metal wire, a capacitor unit portion 201 formed by connecting one or a plurality of capacitors in series or in parallel, a magnetic body 202 and a shield portion 203, and is configured by a case (not shown) formed of a resin or a nonmagnetic metal for accommodating them.

The metal wire used for the winding wire portion 200 is preferred to be the Litz wire. The Litz wire refers to a wire which is formed by intertwining a plurality of single bodies of copper, aluminum or the alloy thereof or by intertwining a plurality of filaments with a diameter of 0.2 mm or less obtained by stacking copper, aluminum or the alloy thereof. The number of turns in the winding wire portion 200 is properly adjusted for the purpose of adjusting the inductance of the power receiving coil unit 101. The value of the inductance can determine the resonant frequency by being matched with the value of the electrostatic capacity of the capacitor unit portion 201 to be described later. Therefore, in order to obtain the targeted resonant frequency, the inductance is adjusted via the number of turns of the winding wire portion 200. In the present embodiment, the winding wire portion 200 is formed by winding the Litz wire on an insulating plate 205 made of a resin. Thereby, the insulation between the Litz wire and the magnetic body 202 to be described later can be ensured. In addition, the winding wire portion 200 in the present embodiment is composed of a coil with a spiral structure formed by winding the Litz wire in a direction substantially orthogonal to the thickness direction into a plane.

The capacitor unit portion 201 is composed of a plurality of ceramic capacitors or film capacitors, and the total electrostatic capacity may determine the resonant frequency. Further, in the present embodiment, although one winding wire portion 200 and one capacitor unit portion 201 are connected in series, a plurality of capacitor unit portion 201 may be also connected to the winding wire portion 200 in series or in parallel in order to obtain the targeted resonant frequency. In addition, in the power receiving coil unit 101 of the present embodiment, although the capacitor portion 201 and the winding wire portion 200 are accommodated in a same case, a case for accommodating the capacitor unit portion 201 can be additionally provided, and the capacitor unit portion 201 and the rectification portion may also be integrated together. In other words, the capacitor unit portion 201 is not necessarily contained in the power receiving coil unit 101.

The shield portion 203 mainly functions to inhibit the change of the inductance value in the winding wire portion 200 due to the external effect. That is, the change of the inductance value in the power receiving coil unit 101 due to the effects from the main body of the vehicle, metal constructions present near the ground surface, constructions of a magnetic material or the like can be inhibited. The shield portion 203 is preferably positioned at a side opposite to the opposing power transmitting coil unit 102 with respect to the winding wire portion 200. In addition, the size of the shield portion 203 is preferably configured to cover the winding wire portion 200 when viewed from the thickness direction, and it is more preferable when the external size of the shield portion 203 viewed from the thickness direction is equal to or larger than that of the winding wire portion 200 viewed from the thickness direction, since the external effects can be further reduced. In addition, the thickness of the shield portion 203 in the thickness direction may be 1 mm or more. As such shield portion 203, nonmagnetic metal such as copper, aluminum or the like is preferably used.

It is expected that the magnetic body 202 is composed of the ceramics material with a large specific resistance, a large magnetic permittivity and a low hysteresis lag. For instance, the magnetic material such as ferrite is preferable and a ferrite sintered body containing manganese or zinc is more preferable. Such a magnetic body 202 is disposed at a side opposite to the opposing power transmitting coil unit with respect to the winding wire portion 200 and is parallel to the winding wire portion 200 in a direction orthogonal to the thickness direction. Specifically, the magnetic body 202 is positioned between the winding wire portion 200 and the shield portion 203. That is, in the thickness direction, the winding wire portion 200, the magnetic body 202 and the shield portion 203 are disposed in such sequence in a direction from the power transmitting coil unit 102 to the power receiving coil unit 101. Further, as described above, the magnetic body 202 is preferably electrically insulated from the winding wire portion 200 through the insulating plate 205. Also, the size of the magnetic body 202 is preferably configured to cover the winding wire portion 200 when viewed from the thickness direction, and it is more preferable when the external size of the magnetic body 202 viewed from the thickness direction is equal to or larger than that of the winding wire portion 200 viewed in the thickness direction, since the transmission efficiency between the power receiving coil unit 101 and the power transmitting coil unit 102 is improved.

In the present embodiment, the magnetic body 202 is composed of a plurality of individual pieces, and because it can be prevented from being further divided even if a stress is applied, the power receiving coil unit 101 with a high impact resistance is achieved.

Figure 3:
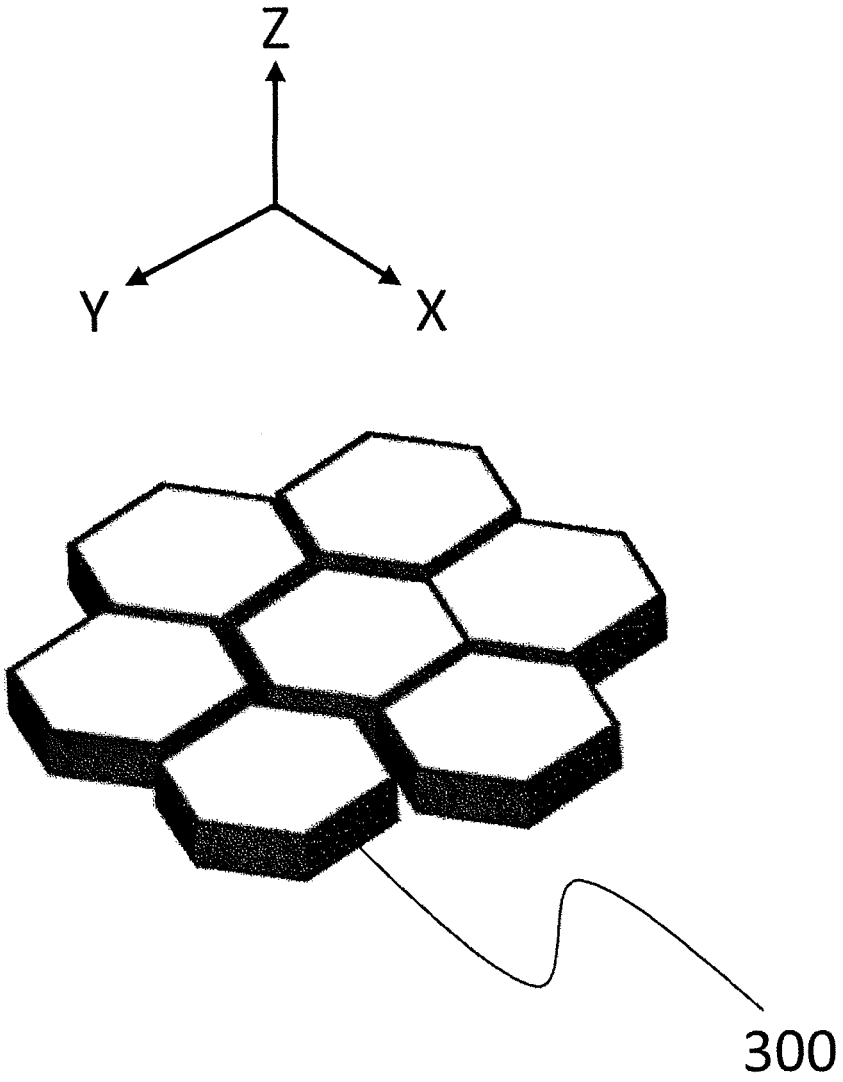
FIG. 3 is a partially enlarged schematic perspective view for showing the shape and the configuration of a plurality of individual pieces in the magnetic body according to the first embodiment of the present invention.

Herein, referring to FIG. 3, the specific shapes of the plurlaity of individual pieces which form the mangetic body 202 will be described in detail. FIG. 3 is a partially enlarged schematic perspective view for showing the shape and the configuration of a plurality of individual pieces in the magnetic body of the first embodiment of the present invention.

As shown in FIG. 3, a magnetic body 300 is configured such that a plurality of individual pieces each having two opposing principle surface in the thickness direction are arranging in rows and columns in a direction substantially orthogonal to the thickness direction. Herein, the thickness direction of the magnetic body 300 (hereinafter only referred to as "the thickness direction") is set as the z-axis direction, the row direction of a plurality of individual pieces is set as the x-axis direction, and the column direction of a plurality of individual pieces is set as the y-axis direction which is orthogonal to both the x-axis and the z-axis in FIG. 3. Further, the thickness direction refers to a direction of the axis with the shortest length when each individual piece is deemed as a solid one. The principle surface refers to a surface with the largest area among a plurality of individual pieces. The two principle surfaces of a plurality of individual pieces are in a polygonal shape, and the interior angles forming the polygon are all obtuse angles (except for the right angle). The fact that all the interior angles in the polygon are obtuse angles means that the polygon is the one whose vertexes are at least more than that of a quadrangle and all the interior angles at the vertexes are larger than the right angle. For example, a regular polygon such as a substantially regular pentagon or a substantially regular hexagon except the regular trigon or the regular quadrangle may be exemplified, and even if it is not a regular polygon, it may be configured by a trigon in which all the interior angles at the vertexes are larger than the right angle. Further, in the present embodiment, the two principle surfaces of a plurality of individual pieces of the magnetic body 300 are both hexagonal but it is not limited thereto, it may be the one in which a regular pentagon and a regular hexagon coexist, and it may also be the one in which various shapes coexist as along as it is a polygon in which all the interior angles are obtuse angles (except for the right angle).

As described above, a plurality of individual pieces are disposed to be adjacent to each other in the row direction and the column direction, i.e., are disposed in rows and columns. At the time, the adjacent individual pieces among a plurality of individual pieces may also be disposed so as to abut each other. In addition, when the two principle surfaces of a plurality of individual pieces are composed of the regular hexagons as in the present embodiment, as shown in FIG. 3, a plurality of individual pieces are disposed such that two individual pieces in the row direction are closest and four individual pieces in the column direction are closest with respect to one certain individual piece. In other words, six surrounding individual pieces are disposed to be closest to one certain individual piece. In addition, in the present embodiment, a plurality of individual pieces are disposed such that the two principle surfaces are substantially parallel in a direction substantially orthogonal to the thickness direction as shown in FIG. 3. Thus, the direction of the magnetic flux induced by the power transmitting coil unit 102 is parallel to the direction in which the two principle surfaces extend. Further, although the two principle surfaces of all the individual pieces of the magnetic body 300 are preferred to be in polygonal shape and all the interior angles forming the polygon are obtuse angles (except for the right angle), the two principle surfaces of some individual pieces among a plurality of individual pieces of the magnetic body 300 may also be in polygonal shape in which the interior angles include sharp angles. For example, the two principle surfaces of a plurality of individual pieces disposed at a location where a stress can be easily applied and the magnetic flux density is high may be configured such that they are in polygonal shape and all the interior angles forming the polygon are obtuse angles (except for the right angle), while the two principle surfaces of a plurality of individual pieces at other locations may be configured such that the interior angles forming polygons include sharp angles.

As described above, in the power receiving coil unit 101 of the present embodiment, since the magnetic body 300 is composed of a plurality of individual pieces, the cracking of the magnetic body 300 can be prevented even if a stress is applied and thus the impact resistance can be ensured. Further, since there are no sharp angles in the interior angles of the two principle surfaces opposing in the thickness direction, the concentration of the magnetic flux at a location where the individual pieces are adjacent to each other can be inhibited and the local heating at the adjacent location can be prevented.

(The Second Embodiment)

Figure 4:
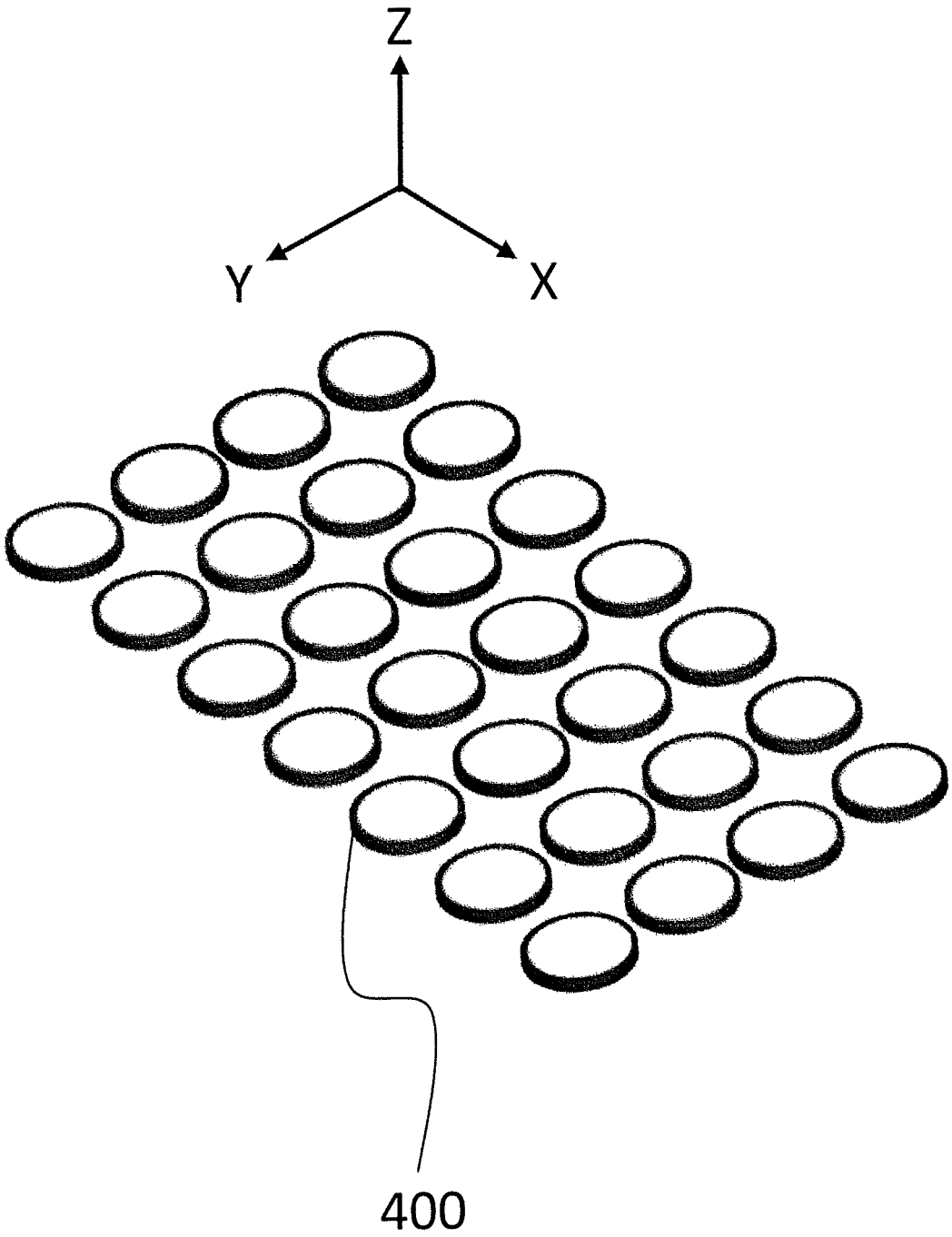
FIG. 4 is a partially enlarged schematic perspective view for showing the shape and the configuration of a plurality of individual pieces in the magnetic body according to the second embodiment of the present invention.

FIG. 4 is a partially enlarged schematic perspective view for showing the shape and the configuration of a plurality of individual pieces in the magnetic body according to the second embodiment of the present invention. In the second embodiment, the shapes of a plurality of individual pieces forming a magnetic body 400 are different from those in the first embodiment. Hereinafter, the explanation will be focused on the aspects different from those of the first embodiment.

Similar to the power receiving coil unit 101 according to the first embodiment, the magnetic body 400 in the present embodiment is configured such that a plurality of individual pieces with two principle surfaces opposing in the thickness direction are disposed in rows and columns in a direction substantially orthogonal to the thickness direction. Herein, the thickness direction of the magnetic body 400 (hereinafter only referred to as "the thickness direction") is set as the z-axis direction, the row direction of a plurality of individual pieces is set as the x-axis direction, and the column direction of a plurality of individual pieces is set as the y-axis direction which is orthogonal to both the x-axis and the z-axis in FIG. 4. The thickness direction refers to a direction of the axis with the shortest length when each individual piece is deemed as a solid. The principle surface refers to a surface with the largest area among the individual pieces of the magnetic body 400. In the present embodiment, the two principle surfaces in a plurality of individual pieces are in a substantially circular shape. The substantially circular shape mentioned herein not only means a perfectly circular shape but also includes an elliptical shape. Also, in the present embodiment, the two principle surfaces of a plurality of individual pieces in the magnetic body 400 are all in a perfectly circular shape, but it is not limited thereto, and the perfectly circular shape and the elliptical shape may coexist.

As described above, a plurality of individual pieces are disposed to be adjacent in the row direction and the column direction, i.e., they are disposed in rows and columns. At the time, the adjacent individual pieces among a plurality of individual pieces may also be disposed to abut each other. In addition, when the two principle surfaces of a plurality of individual pieces are composed of perfect circles as in the present embodiment, a plurality of individual pieces are configured such that two individual pieces in the row direction are closest to a certain individual piece and two individual pieces in the column direction are closest to the certain individual piece as shown in FIG. 4. In other words, four surrounding individual pieces are disposed to be closest to a certain individual piece. In addition, in the present embodiment, a plurality of individual pieces are configured such that the two principle surfaces are substantially parallel in a direction substantially orthogonal to the thickness direction as shown in FIG. 4. Thus, the direction of the magnetic flux induced by the power transmitting coil unit 102 is parallel to the direction in which the two principle surfaces extend. Further, the two principle surfaces of all the individual pieces in the magnetic body 400 are preferred to be in a substantially circular shape, but the two principle surfaces of some individual pieces among a plurality of individual pieces in the magnetic body 400 may also be in a trigonal or tetragonal shape. For example, the two principle surfaces of a plurality of individual pieces at a location where a stress can be easily applied and the magnetic flux density is high may be in a substantially circular shape while the two principle surfaces of a plurality of individual pieces at other locations may be in a triangular or quadrangular shape.

As described above, in the present embodiment, since the magnetic body 400 is composed of a plurality of individual pieces, the cracking of the magnetic body 400 can be prevented even if a stress is applied, and thus the impact resistance can be ensured. Further, since there are no sharp angles in the interior angles in the two principle surfaces opposing in the thickness direction, the concentration of the magnetic flux at a location where the individual pieces are adjacent to each other can be inhibited and the local heating at the adjacent location can be prevented. In addition, since each individual piece is in a substantially circular shape, the powder of the magnetic body generated due to the friction caused by the impact at the adjacent location between individual pieces can be effectively prevented from dropping off.

(The Third Embodiment)

Figure 5:
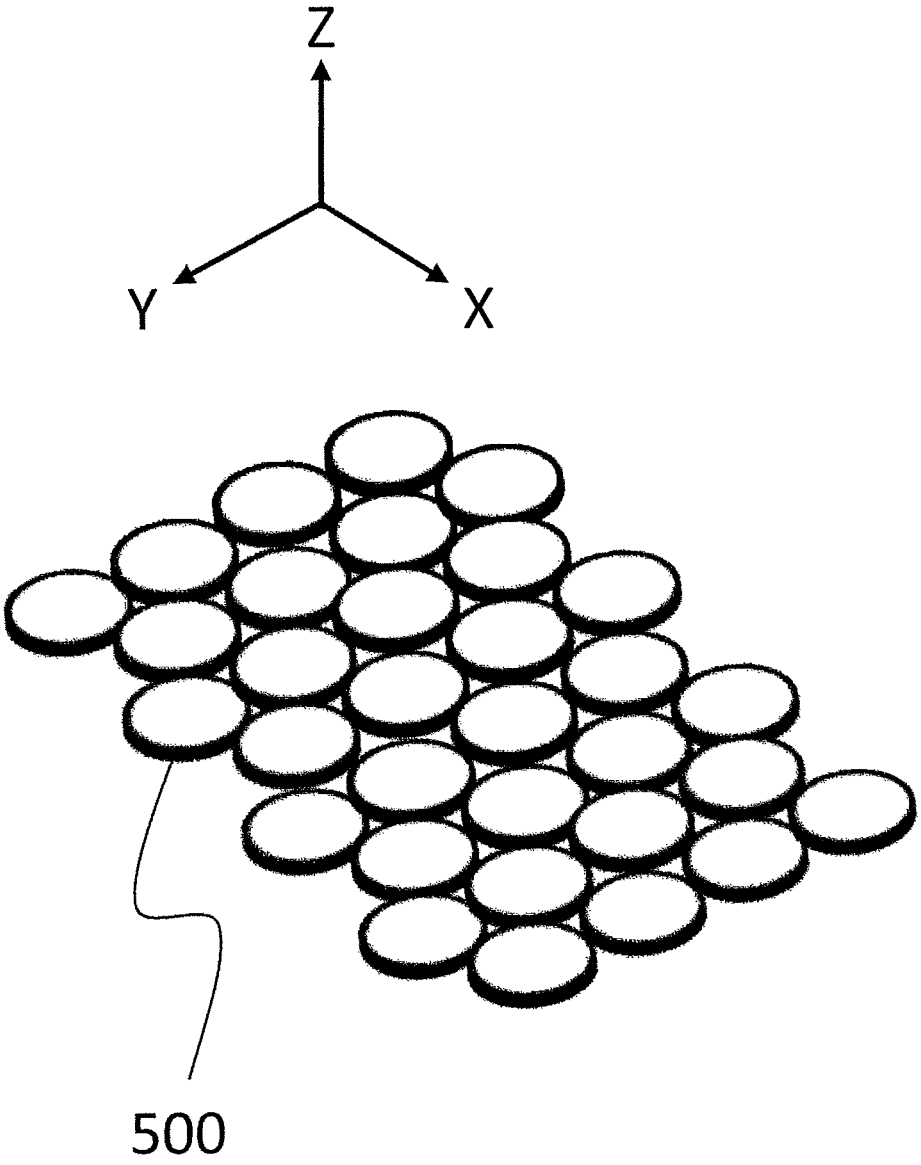
FIG. 5 is a partially enlarged schematic perspective view for showing the shape and the configuration of a plurality of individual pieces in the magnetic body according to the third embodiment of the present invention.

FIG. 5 is a partially enlarged schematic perspective view for showing the shape and the configuration of a plurality of individual pieces in the magnetic body according to the third embodiment of the present invention. In the third embodiment, the shape in which a plurality of individual pieces forming a magnetic body 500 are disposed in rows and columns is different from that in the second embodiment. Hereinafter, the explanation will be focused on the aspects different from those of the second embodiment.

Similar to the magnetic body 400 according to the second embodiment, the magnetic body 500 of the present embodiment is configured such that a plurality of individual pieces with two principle surfaces opposing in the thickness direction are disposed in rows and columns in a direction substantially orthogonal to the thickness direction. Herein, the thickness direction of the magnetic body 500 (hereinafter only referred to as "the thickness direction") is set as the z-axis direction, the row direction of a plurality of individual pieces is set as the x-axis direction, and the column direction of a plurality of individual pieces is set as the y-axis direction which is orthogonal to both the x-axis and the z-axis in FIG. 5. The thickness direction refers to a direction of the axis with the shortest length when each individual piece is deemed as a solid. The principle surface refers to a surface with the largest area among the individual pieces of the magnetic body 500. In the present embodiment, the two principle surfaces of a plurality of individual pieces are in a substantially circular shape. The substantially circular shape mentioned here means not only a perfectly circular shape but also includes an elliptic shape.

In the present embodiment, a plurality of individual pieces are disposed in a zigzag pattern as shown in FIG. 5. That is, a plurality of individual pieces are disposed such that the position of the individual pieces in the columns adjacent to each other is staggered for a pitch in the column direction. In other words, the central part of a column of individual pieces and the central part of the other column of individual pieces in the adjacent columns of a plurality of individual pieces are staggered in the column direction. Herein, the fact that the central part of a column of individual pieces and the central part of the other column of individual pieces are staggered in the column direction means that six surrounding individual pieces are closest to a vicinity of a certain individual piece as shown in FIG. 5. With such a configuration, the densest structure can be formed in which the number of the individual pieces in the magnetic body 500 per volume is the highest.

As described above, in the present embodiment, a plurality of individual pieces forming the magnetic body 500 are disposed in a zigzag pattern. Therefore, the number of individual pieces per volume can be effectively increased in the power receiving coil unit 101, and thus the actual specific permeability of the power receiving coil unit 101 is increased, and further, the coupling efficiency between the power transmitting coil unit 102 and the power receiving coil unit 101 can be improved.

(The Fourth Embodiment)

Figure 6:
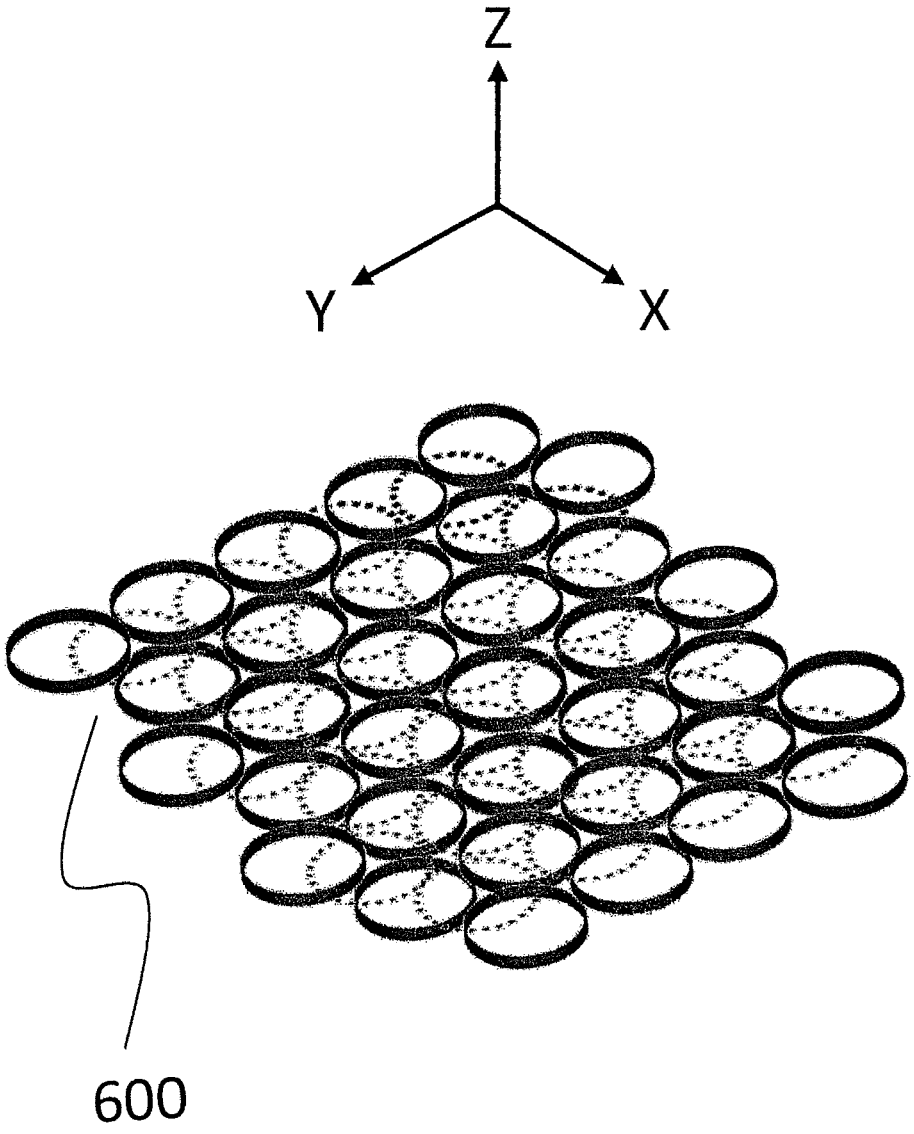
FIG. 6 is a partially enlarged schematic perspective view for showing the shape and the configuration of a plurality of individual pieces in the magnetic body according to the fourth embodiment of the present invention.

FIG. 6 is a partially enlarged schematic perspective view for showing the shape and the configuration of a plurality of individual pieces in the magnetic body according to the fourth embodiment of the present invention. In the fourth embodiment, the shape in which a plurality of individual pieces forming the magnetic body 600 disposed in layers is different from that in the third embodiment. Hereinafter, the explanation will be focused on the aspects different from those of the third embodiment. Herein, the thickness direction of the magnetic body 600 (hereinafter only referred to as "the thickness direction") refers to the arrow direction illustrated in FIG. 6.

In the present embodiment, a plurality of individual pieces forming the magnetic body 600 are disposed in layers in the thickness direction, and the central parts of a plurality of individual pieces are disposed not to overlap each other when viewed from the thickness direction as shown in FIG. 6. In specific, they are disposed such that the central part of the individual pieces in the second layer is positioned at the adjacent location between the individual pieces of the first layer. In the present embodiment, the configuration with two layers has been shown, but more layers may be disposed. In this case, the central parts of a plurality of individual pieces in multiple layers do not overlap each other in the thickness direction.

As described above, in the present embodiment, a plurality of individual pieces forming the magnetic body 600 are disposed in layers in the thickness direction, and the central parts of a plurality of individual pieces do not overlap each other when viewed from the thickness direction. Therefore, the adjacent location between individual pieces disposed in rows and columns at one of the adjacent layers does not coincide with the adjacent location between individual pieces disposed in rows and columns at the other one of the adjacent layers in the thickness direction, and thus part of the magnetic flux leaked to outside the magnetic body will enter the individual piece in an adjacent layer during the magnetic flux passing through the adjacent location between individual pieces so that the magnetic flux will hardly leak to outside the power receiving coil unit 101. As a result, the actual magnetic permeability of the power receiving coil unit 101 is increased, and further, the coupling efficiency between the power transmitting coil unit 102 and the power receiving coil unit 101 can be improved.

EXAMPLES

Hereinafter, the present invention will be more specifically explained by examples, but the present invention is not limited to these examples.

Example 1

The power receiving coil unit in Example 1 was formed as follows. A Litz wire of copper obtained by intertwining 4000 bare wires with a diameter of 0.05 mm was used to the winding wire portion. The winding wire portion became almost square with an external size of 250 mm by winding the Litz wire for 23 turns, and the inductance value of the power receiving coil unit was set to be 100 uH. In addition, a plurality of ceramic capacitors were used to the capacitor unit portion, and a total electrostatic capacity of 25 nF is obtained. Then, the capacitor unit portion and the winding wire portion were connected in series, and as a result of that, a resonant frequency of 100 kHz is obtained. Further, aluminum with a thickness of 2 mm and an external size of 280 mm was used to the shield portion.

Figure 7:
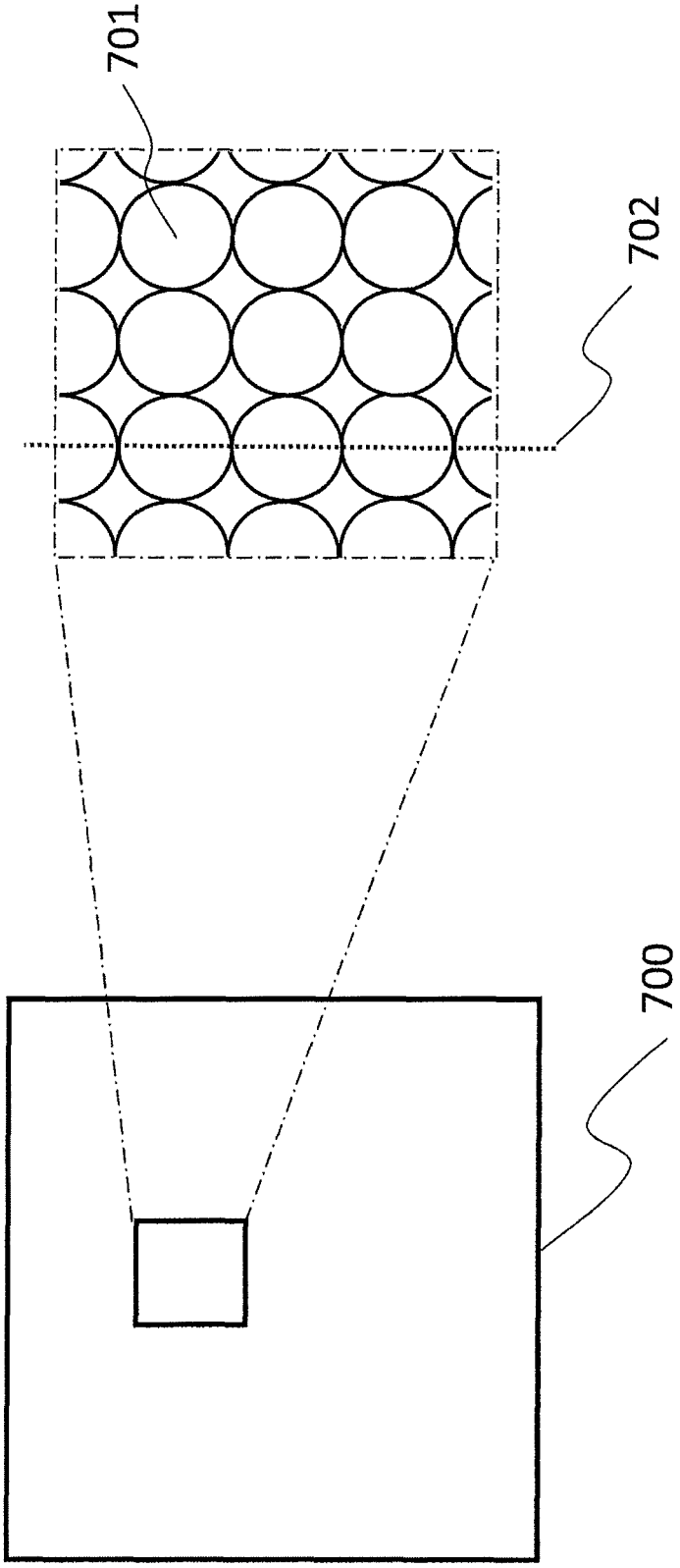
FIG. 7 is a partially enlarged schematic view for showing the shape and the configuration of a plurality of individual pieces forming the magnetic body of Example 1.

Next, a plurality of individual pieces of the magnetic body were formed as follows. FIG. 7 was a schematic view showing the shape and the configuration of a plurality of individual pieces forming the magnetic body of Example 1. As for the size of a plurality of individual pieces 701 of the magnetic body 700, a cylinder with a diameter of 14 mm and a thickness of 2 mm is used. As shown in FIG. 7, four surrounding individual pieces were disposed to be closest to a certain individual piece. In addition, the external size (the lengths in the row direction and the column direction) of the aggregation of a plurality of individual pieces 701 which form the magnetic body 700 was 280 mm.

With respect to the winding wire portion, these winding wire portion, magnetic body 700 and the shield portion are configured such that an insulating plate of polycarbonate with a thickness of 3 mm was disposed on a surface of the power transmitting coil unit opposite to the winding wire portion, the aggregation of a plurality of individual pieces 701 which form the magnetic body 700 was disposed, and the shield portion was further disposed.

The power receiving coil unit of Example 1 with such a configuration was used to perform the wireless power transmission in a state where an electric load device (produced by Kikusui Electronics Corporation; product code: PLZ1004WH) was connected downstream the rectification portion. The load setting of the electronic load was adjusted so that the transmitted power had a direct current of 13 Arms and a power of 3.3 kW after rectified by the rectification portion. In order to investigate the local heating at the location where a plurality of individual pieces forming the magnetic body adjoined in the transmission test with a power of 3.3 kW, a thermal camera (produced by NEC Avio Infrared Technology; product code: F20W) and a thermoelectric couple (produced by Yokogawa Electric Corporation; product code: DU-100) were used to measure the thermal distribution at each location where a plurality of individual pieces forming the magnetic body adjoined along the measurement line 702 shown in FIG. 7 after 30 minutes of power transmission was performed.

Example 2

Figure 8:
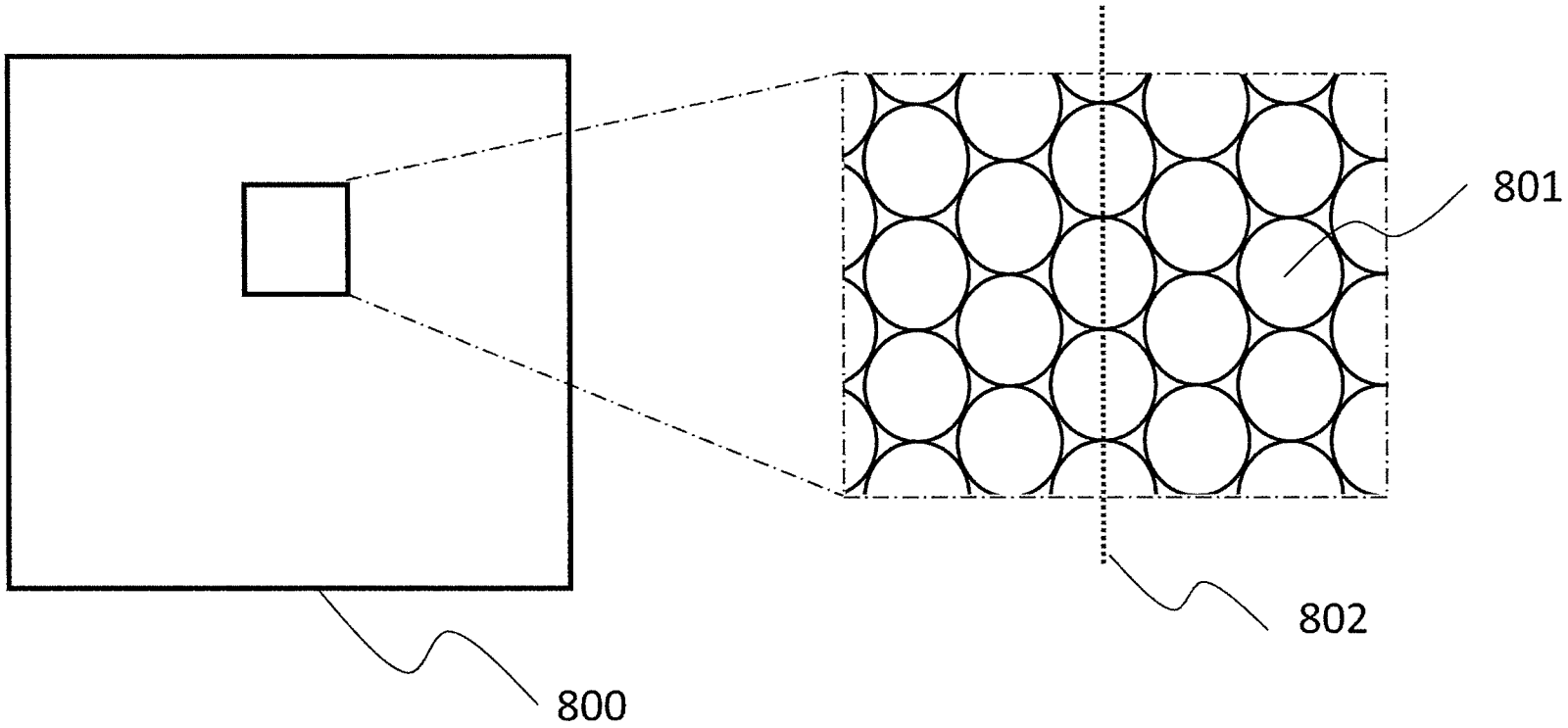
FIG. 8 is a schematic view showing the shape and the configuration of a plurality of individual pieces forming the magnetic body of Example 2.

The power receiving coil unit of Example 2 was formed as follows. FIG. 8 is a schematic view showing the shape and the configuration of a plurality of individual pieces forming the magnetic body of Example 2. As shown in FIG. 8, the same structure of the power receiving coil unit as that of Example 1 was obtained except that the individual pieces were disposed in rows and columns so that six surrounding individual pieces are closest to a certain individual piece.

As in Example 1, the power receiving coil unit of Example 2 with such a configuration was used to investigate the local heating at the location where a plurality of individual pieces 801 forming the magnetic body 800 adjoined in the transmission test with a power of 3.3 kW. A thermal camera (produced by NEC Avio Infrared Technology; product code: F20W) and a thermoelectric couple (produced by Yokogawa Electric Corporation; product code: DU-100) were used to measure the thermal distribution at each location where a plurality of individual pieces 801 forming the magnetic body 800 adjoined along the measurement line 802 shown in FIG. 8 after 30 minutes of power transmission was performed.

Comparative Example 1

Figure 9:
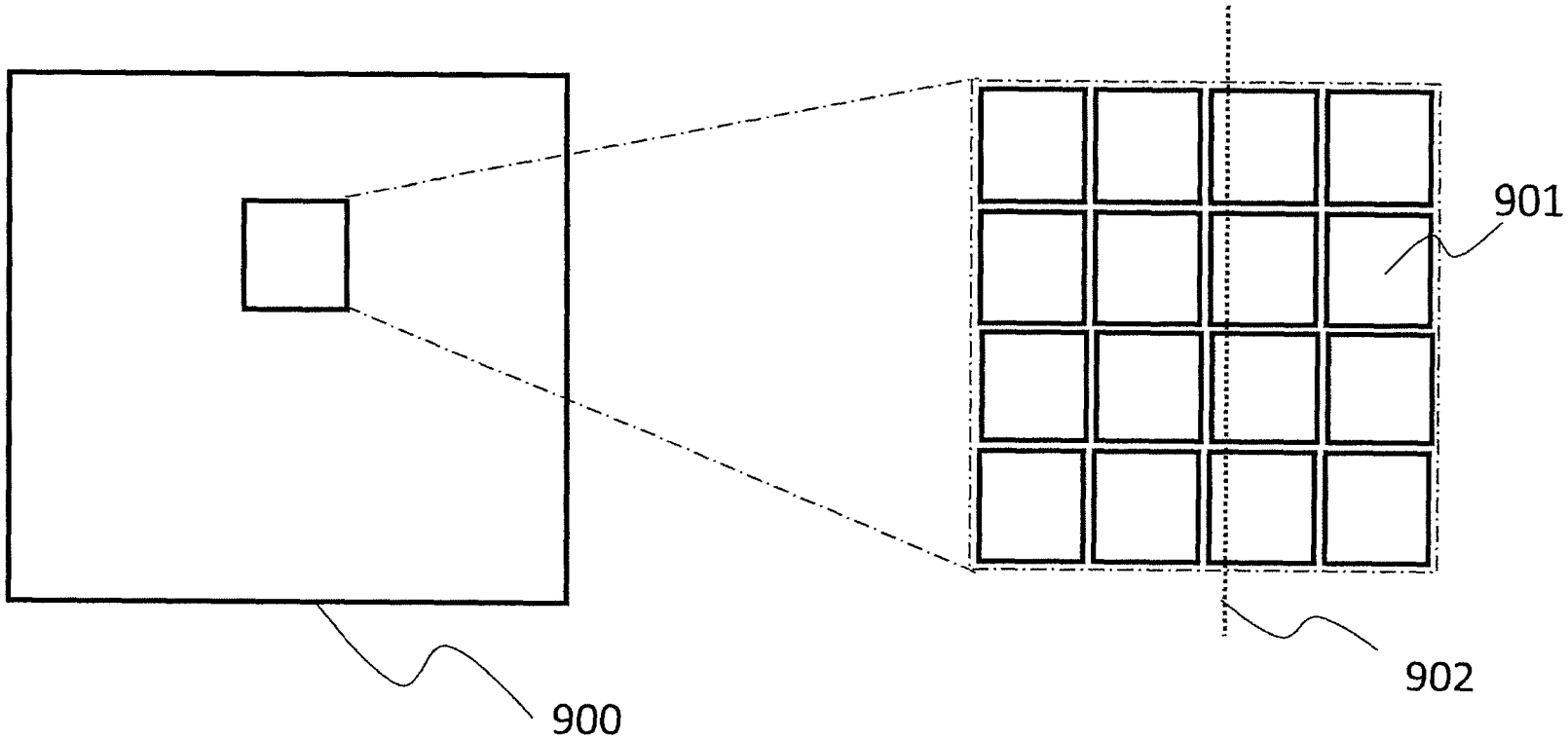
FIG. 9 is a schematic view showing the shape and the configuration of a plurality of individual pieces forming the magnetic body of Comparative Example 1.

The power receiving coil unit of Comparative Example 1 was formed as follows. FIG. 9 is a schematic view showing the shape and the configuration of a plurality of individual pieces forming the magnetic body of Comparative Example 1. As shown in FIG. 9, the same structure of the power receiving coil unit as that of Example 1 was obtained except that a quadrangular prism with a length of a side being 14 mm and a thickness being 2 mm is used to each of a plurality of individual pieces 901 forming the magnetic body 900 and the individual pieces were disposed in rows and columns so that four surrounding individual pieces are closest to a certain individual piece.

As in Example 1, the power receiving coil unit of Comparative Example 1 with such a configuration was used to investigate the local heating at the location where a plurality of individual pieces 901 forming the magnetic body 900 adjoined in the transmission test with a power of 3.3 kW. A thermal imaging camera (produced by NEC Avio Infrared Technology; product code: F20W) and a thermoelectric couple (produced by Yokogawa Electric Corporation; product code: DU-100) were used to measure the thermal distribution at each location where a plurality of individual pieces 901 forming the magnetic body 900 adjoined along the measurement line 902 shown in FIG. 9 after 30 minutes of power transmission was performed.

Figure 10:
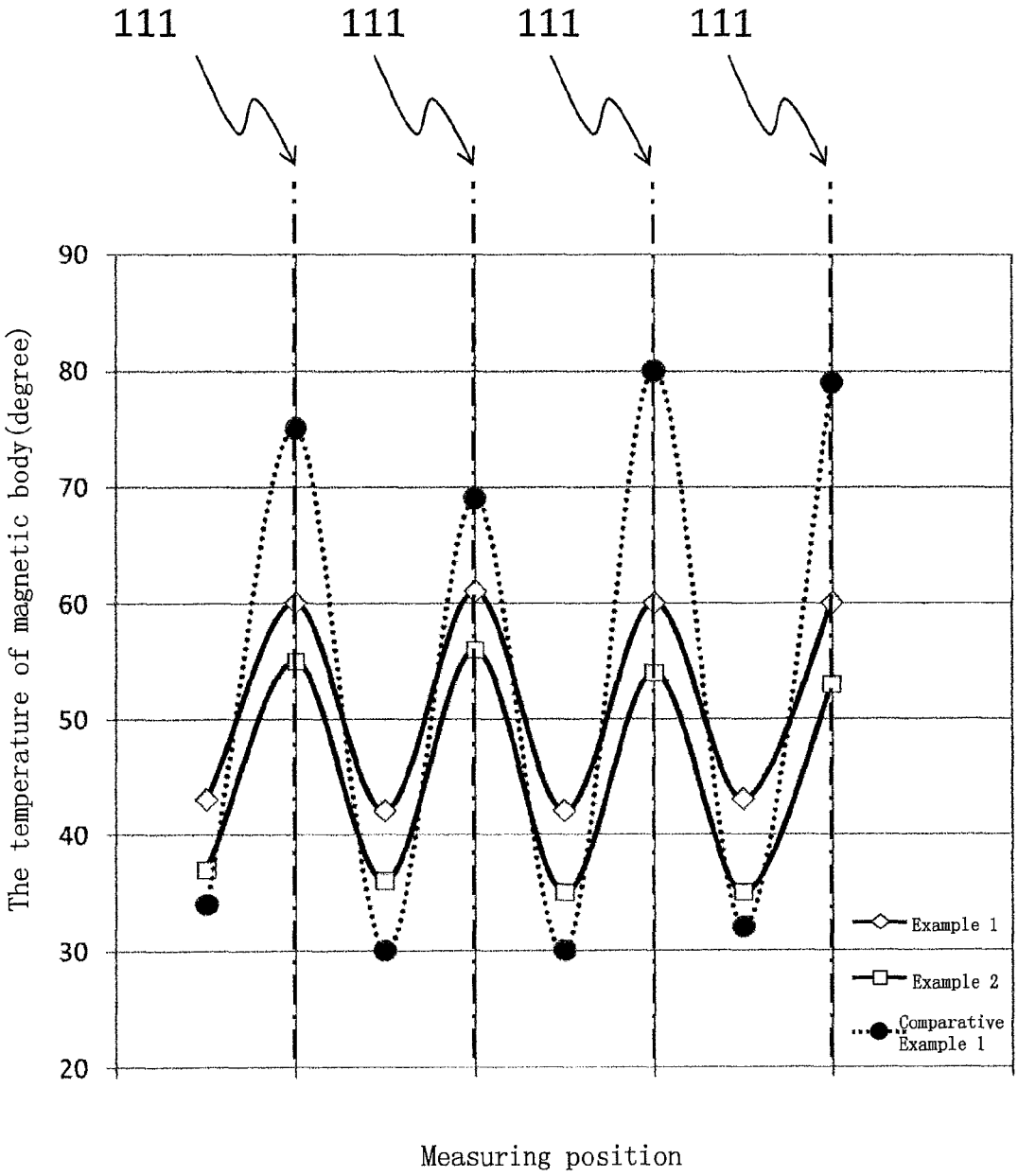
FIG. 10 is a graph showing the measurement result of the thermal distribution in the magnetic bodies from Example 1, Example 2 and Comparative Example 1.

The measuring results from Example 1, Example 2 and Comparative Example 1 were shown in FIG. 10. The vertical axis in the graph of FIG. 10 represented the temperature of the magnetic body and the transverse axis represented the measuring position. In addition, the position of the arrow 111 in FIG. 10 represented the position where the individual pieces of the magnetic body adjoined. As shown in FIG. 10, it was confirmed that the temperature at the position where a plurality of individual pieces forming the magnetic body adjoined was lower in Examples 1 and 2 than that of Comparative Example 1, that is to say, the local heating at the location where individual pieces adjoined can be effectively inhibited.

The present invention has been described based on the embodiments. These embodiments are exemplary, and various modifications and variations are possible within the scope defined by the claims of the present invention. Those skilled in the art will understand these modified examples and variations fall within the scope defined by the claims of the present invention. Thus, the description and the drawings are not limiting and should be deemed as exemplary.

For example, it goes without saying that even if the two principle surfaces of a plurality of individual pieces in the magnetic body are configured such that the structure in which a polygonal shape is present and all the interior angles forming the polygon are obtuse angles (except for the right angle) as shown in the first embodiment and the structure in which a substantially circular shape is present as shown in the second embodiment coexist, the effect of the present invention can also be obtained.

The coil unit of the present invention can be used in the coil unit of a wireless power supply system for charging a vehicle such as a battery electric vehicle or a plug-in hybrid electric vehicle.

What is claimed is:

1. A coil unit for wirelessly transmitting or receiving power, comprising:

a winding wire; and a magnetic body, wherein in the magnetic body, a plurality of individual pieces with two principal surfaces opposing to each other in a thickness direction are disposed in rows and columns in a direction substantially orthogonal to the thickness direction, and the two principal surfaces are in a polygonal shape, and the polygonal shape has all obtuse angles and no right angle, wherein the plurality of individual pieces are disposed in layers in the thickness direction, and wherein central parts of the plurality of individual pieces do not overlap each other when viewed from the thickness direction.

2. A coil unit for wirelessly transmitting or receiving power, comprising:

a winding wire; and a magnetic body, wherein in the magnetic body, a plurality of individual pieces with two principal surfaces opposing in a thickness direction are disposed in rows and columns in a direction substantially orthogonal to the thickness direction, wherein the two principal surfaces are in a substantially circular shape, wherein the plurality of individual pieces are disposed in layers in the thickness direction, and wherein central parts of the plurality of individual pieces do not overlap each other when viewed from the thickness direction.

3. The coil unit of claim 2, wherein, the plurality of individual pieces are disposed in a zigzag pattern.

* * * * *